US009302844B1

(12) United States Patent
Gringer et al.

(10) Patent No.: US 9,302,844 B1
(45) Date of Patent: Apr. 5, 2016

(54) BLADE DISPENSER

(71) Applicant: ALLWAY TOOLS, INC., Bronx, NY (US)

(72) Inventors: Donald Gringer, New York, NY (US); Yuan Fang Cheng, Syosset, NY (US)

(73) Assignee: ALLWAY TOOLS, INC., Bronx, NY (US)

( * ) Notice: Subject to any disclaimer, the term of this patent is extended or adjusted under 35 U.S.C. 154(b) by 0 days.

(21) Appl. No.: 14/636,269

(22) Filed: Mar. 3, 2015

(51) Int. Cl.
*B65D 83/10* (2006.01)
*B65D 83/00* (2006.01)

(52) U.S. Cl.
CPC ..... *B65D 83/10* (2013.01); *B65D 83/0038* (2013.01)

(58) Field of Classification Search
CPC ..... B65D 83/10
USPC ..... 221/279
See application file for complete search history.

(56) References Cited

U.S. PATENT DOCUMENTS

| | | | | |
|---|---|---|---|---|
| 2,641,358 | A | 6/1953 | Santo | |
| 3,040,929 | A | 6/1962 | Tapper | |
| 3,288,329 | A | 11/1966 | Ketchem | |
| 3,650,433 | A | 3/1972 | Robertson | |
| D224,290 | S | 7/1972 | Robertson | |
| 4,379,514 | A | 4/1983 | Joffe | |
| 4,789,080 | A | 12/1988 | Iten | |
| 4,826,042 | A | 5/1989 | Vujovich | |
| 4,887,739 | A | 12/1989 | Parker | |
| 5,100,021 | A | 3/1992 | Mussi et al. | |
| 5,251,783 | A * | 10/1993 | Gringer | 221/102 |
| 2004/0099682 | A1 * | 5/2004 | Huang | 221/232 |
| 2009/0194557 | A1 * | 8/2009 | Van Deursen | 221/232 |
| 2014/0374430 | A1 * | 12/2014 | Meier et al. | 221/1 |

OTHER PUBLICATIONS

Allway Tools, Soft Grip Tools for Hard Hat Jobs, Product Catalog, 2014.

* cited by examiner

*Primary Examiner* — Patrick Mackey
(74) *Attorney, Agent, or Firm* — Gottlieb, Rackman & Reisman P.C.

(57) ABSTRACT

A blade dispenser for housing a plurality of unshelled blades and dispensing the blades one at a time therefrom. The dispenser includes a housing that has tracks forming a guide, a dispensing slot at one end of the housing and a filling end at the other end of the housing, a pusher that is mounted on the track within the housing, abuts the blades and is moveable from the filling end toward the dispensing slot to aid in dispensing the blades and a spring that is located within the housing and engages the pusher and the housing and biases the pusher and the blades toward the dispensing slot.

21 Claims, 9 Drawing Sheets

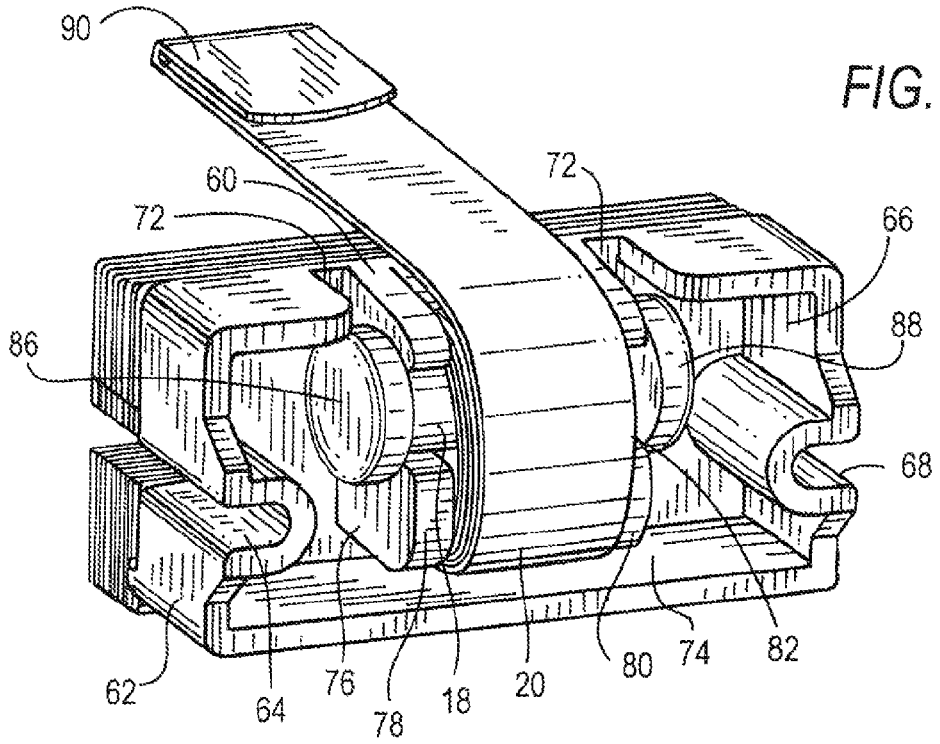
FIG. 3
FIG. 6
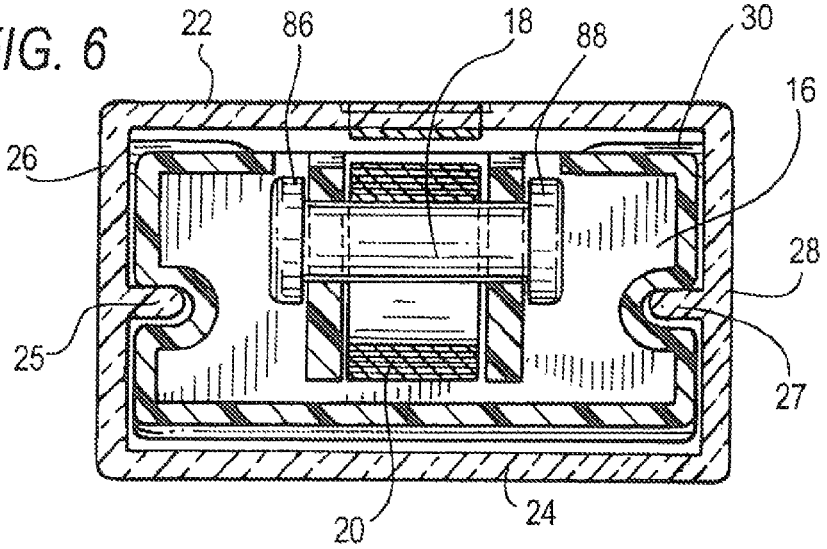

BLADE DISPENSER

FIELD OF THE INVENTION

This invention relates generally to a single edge blade dispenser and more specifically to a blade dispenser that allows for unshelled blades to be dispensed therefrom, one at a time.

BACKGROUND OF THE INVENTION

Blade dispensers are well-known in the art. One known dispenser, for example, is U.S. Pat. No. 5,251,783, which is directed to a blade dispenser that includes a housing and a carrier that also includes ratcheting members that interact with the ratcheting members of the housing to allow for movement of the carrier to dispense the blades. However, known dispensers do not provide a cost effective means to allow for unshelled blades to be quickly and easily dispensed therefrom with minimal effort and in a safe manner (i.e., handling the sharp blade from the blade backing).

SUMMARY OF THE INVENTION

The present invention relates broadly to a dispenser that can hold a plurality of unshelled blades and quickly and efficiently dispense them, one at a time, therefrom with one hand safely.

In an embodiment, the dispenser comprises a housing that includes a blade dispensing slot at one end thereof and a filling end at the other end thereof. Tracking means are located within the housing. A blade pusher that engages the plurality of blades, is also located within the housing and mounted on the tracking means for movement from the filling end toward the dispensing slot, and a flat coil spring contactable with the pusher and biases the blades toward the dispensing slot whereby only one of the blades that is adjacent to the dispensing slot is manually removeable through therethrough. In an embodiment, the housing can be made of thermoplastic and can be one of substantially transparent, opaque or a dark solid coloring.

In an embodiment, the housing can include a top wall, a bottom wall, a first sidewall extending between the top wall and the bottom wall and a second sidewall spaced from the first sidewall and extending between the top wall and the bottom wall and a front end wall.

In an embodiment, the slot can be formed in the front end wall and extend transverse between the first sidewall and the second sidewall and a recess can be formed in the front end wall and extend from the slot in the front end wall toward the bottom wall. In an embodiment, the recess can be substantially U-shaped and configured for insertion of a finger to contact and dispense one of the blades from the housing. In an embodiment, the top wall can include a recess formed therein that is configured for engagement with the spring.

In an embodiment, the tracking means can include a first track protruding inwardly from the first sidewall toward the second sidewall and a second track protruding inwardly from the second sidewall toward the first sidewall with the first track and the second track being parallel to each other. A gap can extend between a first end of the first track and the front wall and a first end of the second track and the front wall to allow the blades to be disengaged from the tracks and removed from the dispenser through the slot.

In an embodiment, the dispenser can include a closure that includes a plurality of fasteners and is releasably connectable to the housing at the filling end. In an embodiment, the plurality of openings can be formed in the housing that are adapted to interact with and releasably fix the closure to the housing. In an embodiment, the fasteners are latches that are configured to flexibly be arranged within the openings of the housing. The closure can include a tab extending therefrom for displaying the dispenser.

In an embodiment, the spring can be a constant force spring and can have a curved first end that is configured to extend through the recess formed in the top wall of the housing.

In an embodiment, the dispenser can include a spool that is connectable with the pusher, which can be comprised of a cylindrical body with a first end and a second end that each has a diameter that is greater than the cylindrical body. The spool can be non-rotatably fixed to the pusher or rotatably fixed to the pusher.

In an embodiment, the spring can be arranged on the spool, the spring can extend between the first protrusion and the second protrusion of the pusher and the spring can be prestressed to press against the pusher in an assembled state.

In an embodiment, the pusher can have a substantially linearly extending front face for abutting the blades and can include a first sidewall with a first recess extending inwardly therefrom that is adapted to be arranged on a first track and a second recess extending inwardly therefrom that is adapted to be arranged on the second track. In an embodiment, the pusher can include a first protrusion that extends from the front wall and has a first groove formed therein that extends in a first direction and a second protrusion that extends from the front wall and has a second groove formed therein that is spaced from the first protrusion and that extends in the first direction from the first wall with the spool configured to be retained with the first groove and the second groove of the pusher.

BRIEF DESCRIPTIONS OF THE DRAWINGS

FIG. 3 is a perspective view of the pusher, spool, and spring of the blade assembly of FIG. 1 in an assembled state with a plurality of blades abutting the pusher;

FIG. 6 is a cross-sectional view of the blade dispenser assembly of FIG. 1 taken along line 6-6 of FIG. 5;

DETAILED DESCRIPTION OF EMBODIMENTS OF THE INVENTION

Figure 1:
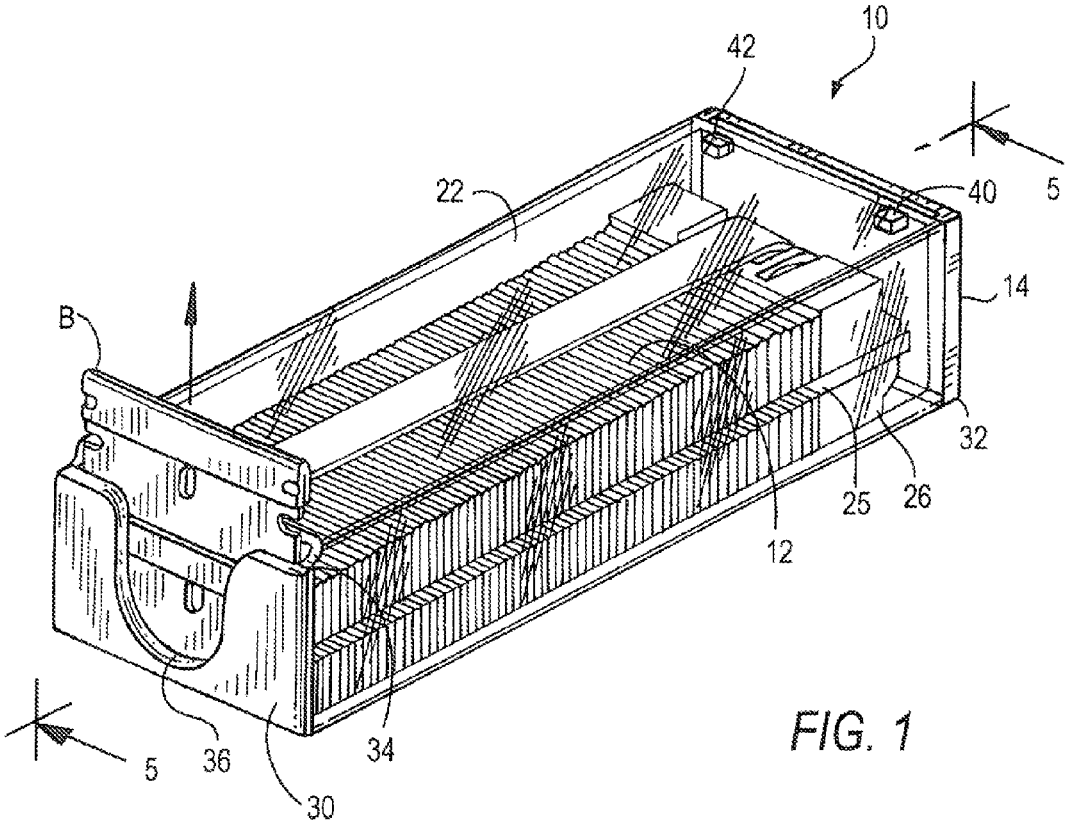
FIG. 1 is a perspective of an embodiment of a blade dispenser assembly of the present invention.

With reference now to the drawings, and in particular to FIGS. 1 through 8, an embodiment of a blade dispenser assembly of the present invention, which is generally designated by the reference numeral 10, will be described.

The dispenser 10 generally includes a housing 12, a closure 14 that is attachable to the housing 12 and a pusher 16, a spool 18 and a spring 20 that are arranged within the housing 12.

FIG. 1 illustrates the dispenser 10 in an assembled state with an unshelled blade B being removed manually therefrom. The blade B has a single, sharp edge, a protective opposite side for gripping and grooves formed in at least each sidewall transverse to the edge and gripping side of the blade B. As can be seen in the figures, the blades B are generally rectangular. However, the shape of the housing 12, the pusher 16 and the closure 14 may be readily modified to correspond with any desired blade shape. Unshelled blades are blades that do not include a wrapping or covering surrounding the blade body (e.g., thin paper or cardboard surrounding the blade and sealed by glue or the like) to protect the blade and attempt to prevent injury prior to removal.

The housing 12 has a substantially hollow interior and includes a top wall 22, a bottom wall 24, a first sidewall 26, a second sidewall 28, a front wall 30 and a rear wall 32. The hollow interior shape of the housing 12 corresponds generally to the shape of blades B to be dispensed therefrom. The front wall 30 has a gap 34 and a recess 36 formed therein. The gap 34 is slightly wider than the width of standard unshelled blade B to allow only a single blade B to be dispensed at a time. In an embodiment, the recess 36 extends from the gap 34 in a substantially U-shaped manner, which allows for an individual to apply pressure with one hand against a sidewall of a blade B and direct the blade B upwardly and outwardly through the gap 34. The top wall 22 includes a recess 23 formed therein at the end of the top wall 22 adjacent the gap 34 formed in the front wall 30. The rear wall 32 has an opening 38 formed therein to allow for a plurality of blades B, the pusher 16, the spool 18 and the spring 20 to be assembled within the housing 12. Additionally, the first sidewall 26 includes a first track 25 that extends therefrom toward the interior cavity of the housing 12 and the second sidewall 26 includes a second track 27 that extends therefrom toward the interior cavity of the housing 12, parallel to the first track 25, the tracks 25, 27 extending toward one another, such that the tracks 25, 27 form a track on which the pusher 16 and blades B are arranged and may slide. A plurality of openings 40, 42, 44, 46 also extend through the top wall 22 and the bottom wall 24 near the rear wall 32 of the housing 12 to aid in securing the closure 14 to the housing 12.

The closure 14 can be sized to extend over the opening 38 formed in the rear wall 32 and to be releasably fixed to the housing 12 by a plurality of fasteners 48, 50, 52, 54. The fasteners 48, 50, 52, 54 are latches that are configured to flexibly be arranged within the openings 40, 42, 44, 46 of the housing 12. To display the dispenser 10 in a retail store, in an embodiment, the dispenser 10 can include a tab that extends from therefrom, for example from the closure 14, with an opening to hang the dispenser 10 on a display hook.

Figure 2:
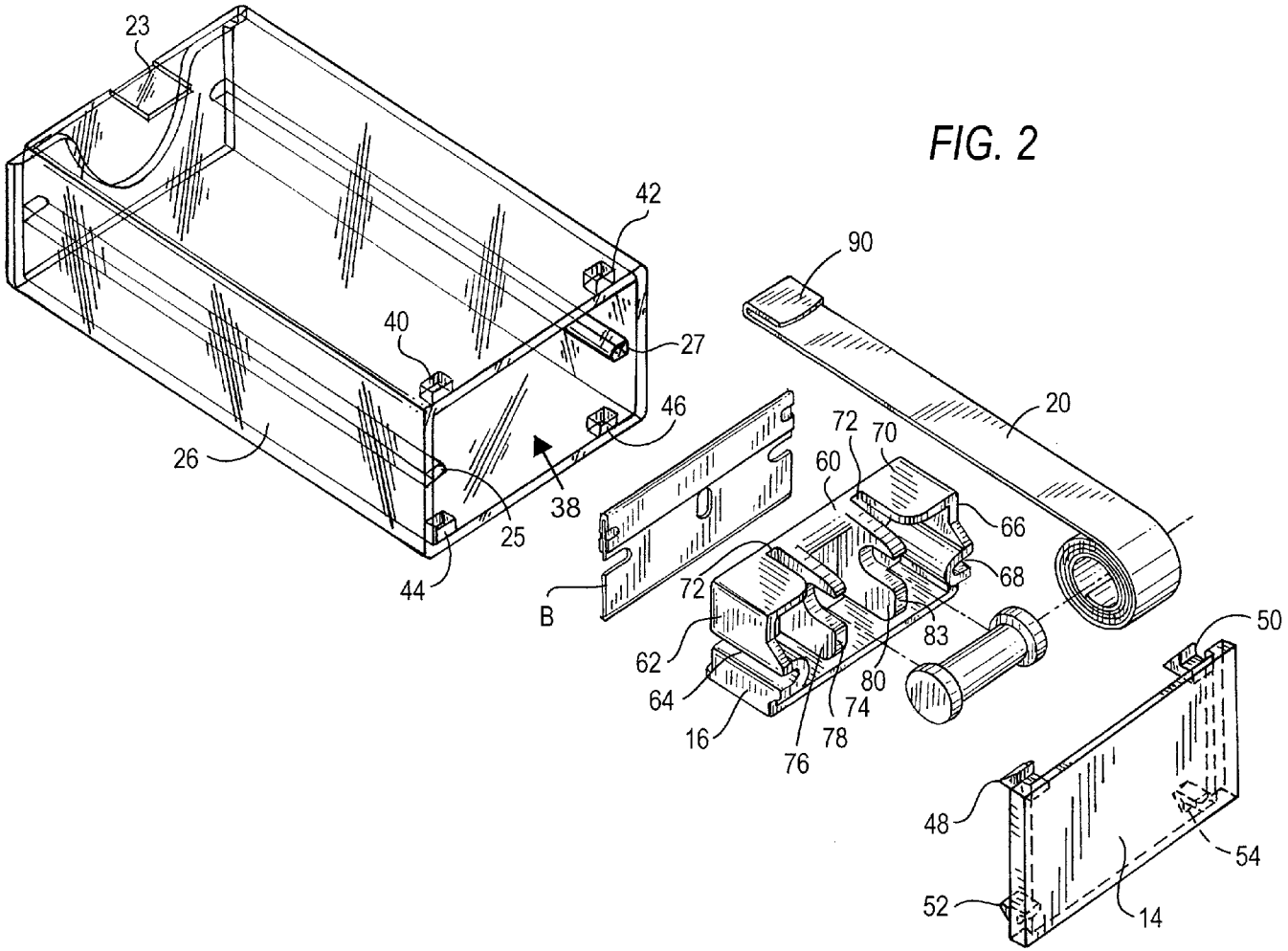
FIG. 2 is an exploded view of the blade assembly of FIG. 1.

FIG. 2 is an exploded view of the dispenser 10. As can be seen, the pusher 16 includes a front wall 60, a first sidewall 62 with a first groove 64 extending inwardly from the first sidewall 62, a second sidewall 66 with a second groove 68 extending inwardly from the second sidewall 66, a top wall 70 with a cutout 72 formed therein and a bottom wall 74. A first flange 76 that has a first recess 78 formed therein and a second flange 80 that has a second recess 82 formed therein both extend outwardly from the front wall 60 toward the rear of the pusher 16.

The spool 18 includes a body 84, a first end 86 and a second end 88 spaced from and opposing the first end 86. As shown in an embodiment in FIG. 2, the spool body 84 is cylindrical and the spool ends 86, 88 have a circumference that is greater than the circumference of the spool body 84 to aid in preventing the spool 18 from moving laterally. Although the spool 18 is shown as being cylindrical, the spool 18 can take the form of any shape such as a rectangle. The spool 18 is releasably fixed within the first recess 78 of the first flange 76 and the second recess 82 of the second flange 80. The spool 18 can either be rotatable about the recesses 78, 82 or non-rotatably fixed within the recesses 78, 82.

In an embodiment, the spring 20 is a constant force spring that is coiled in an initial, resting state and includes a curved end first end 90 for attachment to the recess 23 formed in the top wall 22 of the housing 12. As shown in an embodiment, for example in FIG. 3, the spring 20 can be arranged on the body 12 of the spool 18. The advantage of a constant force spring is that it will, generally, apply constant pressure on the blades B stacked within the housing 12 between the pusher 16 and the front wall 30 as one after another of the blades B are removed from the housing 12 and direct the blades B and pusher 16 toward the front wall of the housing 12, enabling easy removal of the blades B through the gap 34 in the front wall 30 of the housing 12. Such springs are available from Vulcan Spring & Manufacturing Corporation with an office at 501 Schoolhouse Road, Telford, Pa. 18969. However, the spring 20 can be any other spring, which ensures that a force is maintained to direct the blades B toward the front wall 30 of the dispenser 10.

FIG. 3 illustrates the pusher 16, the spool 18, the spring 20 and a plurality of unshelled blades B positioned in front of the front wall 60 of the pusher 18. As can be seen, the grooves 64, 68 of the pusher 18 are aligned with grooves formed in the standard, unshelled blades B such that both the blades B and the pusher 18 can be positioned on the tracks 25, 27 of the housing 12.

Figure 4:
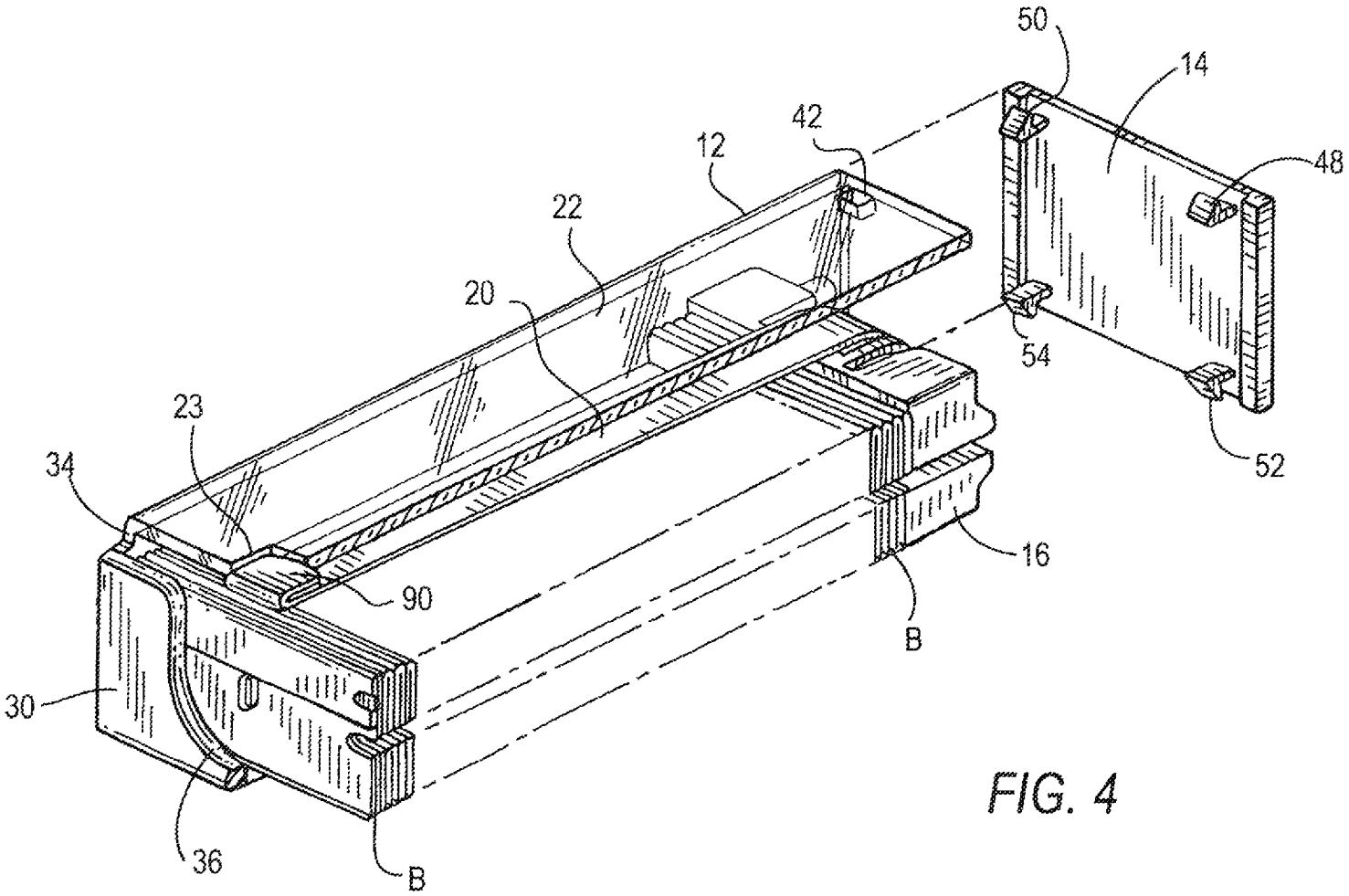
FIG. 4 is a cross-sectional view of the blade dispenser assembly of FIG. 1.
Figure 5:
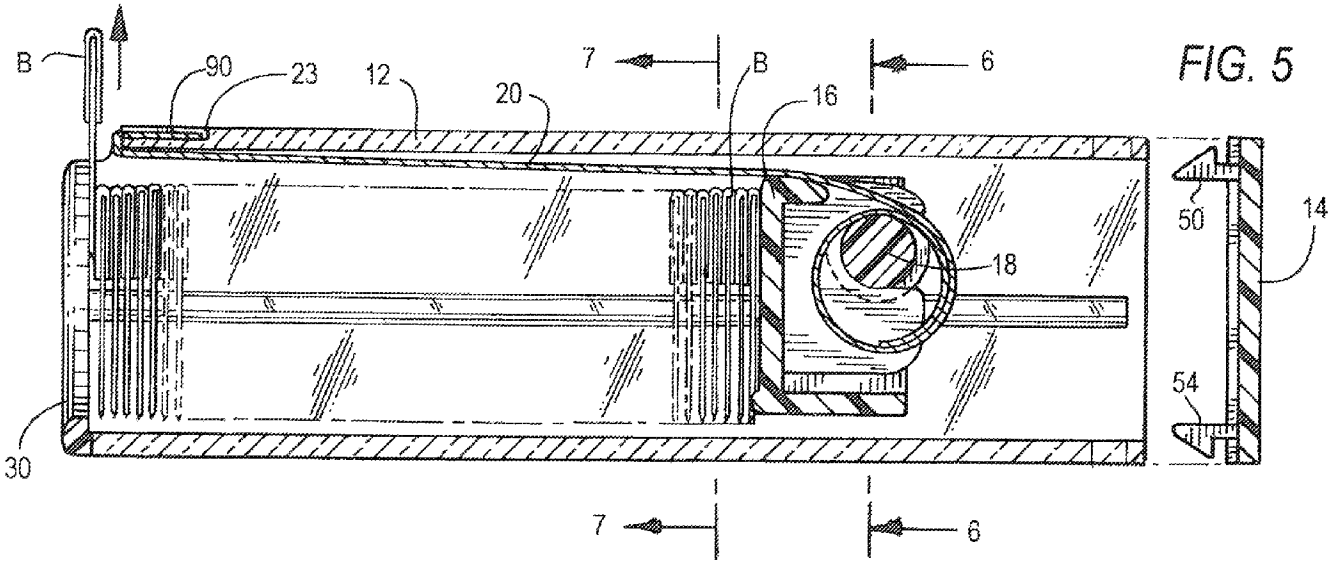
FIG. 5 is a cross-sectional side view of the blade dispenser assembly taken along line 5-5 of FIG. 1.

FIGS. 4 and 5 illustrate cross-sectional views of the dispenser 10 in a loaded state. As shown, the grooves 64, 68 of the pusher 16 are arranged on the track formed by the tracks 25, 27, the spool 18 is arranged in the grooves 78, 82 of the pusher 16, the spring 20 is arranged on the spool 18 and arranged within the cutout 72 in the top wall 70 of the housing 12. A stack of blades B are arranged between the pusher 16 and the front wall 30 of the housing 12. As the blades B are removed manually one at a time from the housing 12, the spring 18 maintains tension on the stack by gradually contracting and applying pressure to the blades B remaining in the housing to ensure that those blades B are continuously moving toward the front wall 30 of the housing 12 for dispensing.

FIG. 6 is a cross-sectional view of the dispenser 10 in an assembled state. As can be seen, the pusher 16 substantially fills the interior of the housing 12 with the grooves 64, 68 substantially encompassing the tracks 25, 27 of the housing 12 that form track within the housing 12 to aid the pusher 16 and blades B arranged in front of the pusher 16 to move toward the front end 30 of the housing 12.

Figure 7:
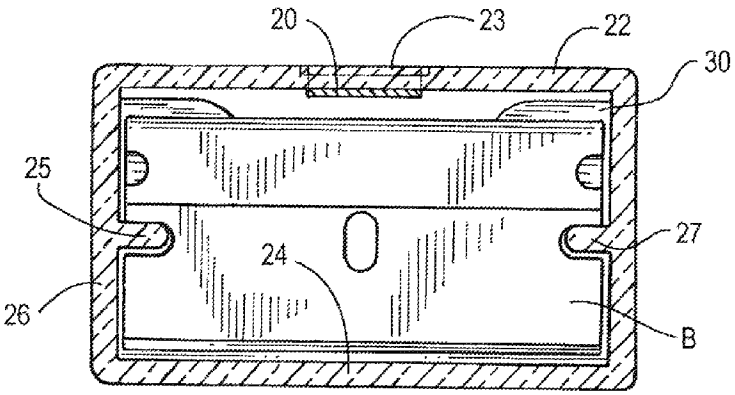
FIG. 7 is a cross-sectional view of the blade dispenser assembly of FIG. 1 taken along line 7-7 of FIG. 5.

FIG. 7 shows a cross-sectional view of the dispenser 10 taken at the blades B arranged therein and looking forward. Upon an application of upward force to the blade B closest to the front wall 30 of the dispenser 12, the blade B will slide outwardly from the dispenser 10 between the gap 34 formed in the front wall 30 and the next blade B will be then pressed against the front wall 30 and ready for dispensing.

At least the housing 12, the closure 14, the pusher 16 and the spool 18 can be made molded or formed and made of a plastic that can be one of substantially transparent, opaque or a dark solid coloring. However, the housing 12, the closure 14, the pusher 16 and the spool 18 can be comprised of any other material that is known may become known, including metal or a composite. The aforesaid transparency allows for a user to view the internal components of the dispenser 10, including the number of blades B remaining therein.

The dispenser 10 is disposable such that it is filled with a plurality of blades B at the time of manufacture and discarded after all of the blades B have been utilized. Alternatively, in an embodiment, the dispenser 10 can be reusable such that the dispenser 10 can be reloaded with a plurality of blades B for dispensing therefrom.

Figure 8:
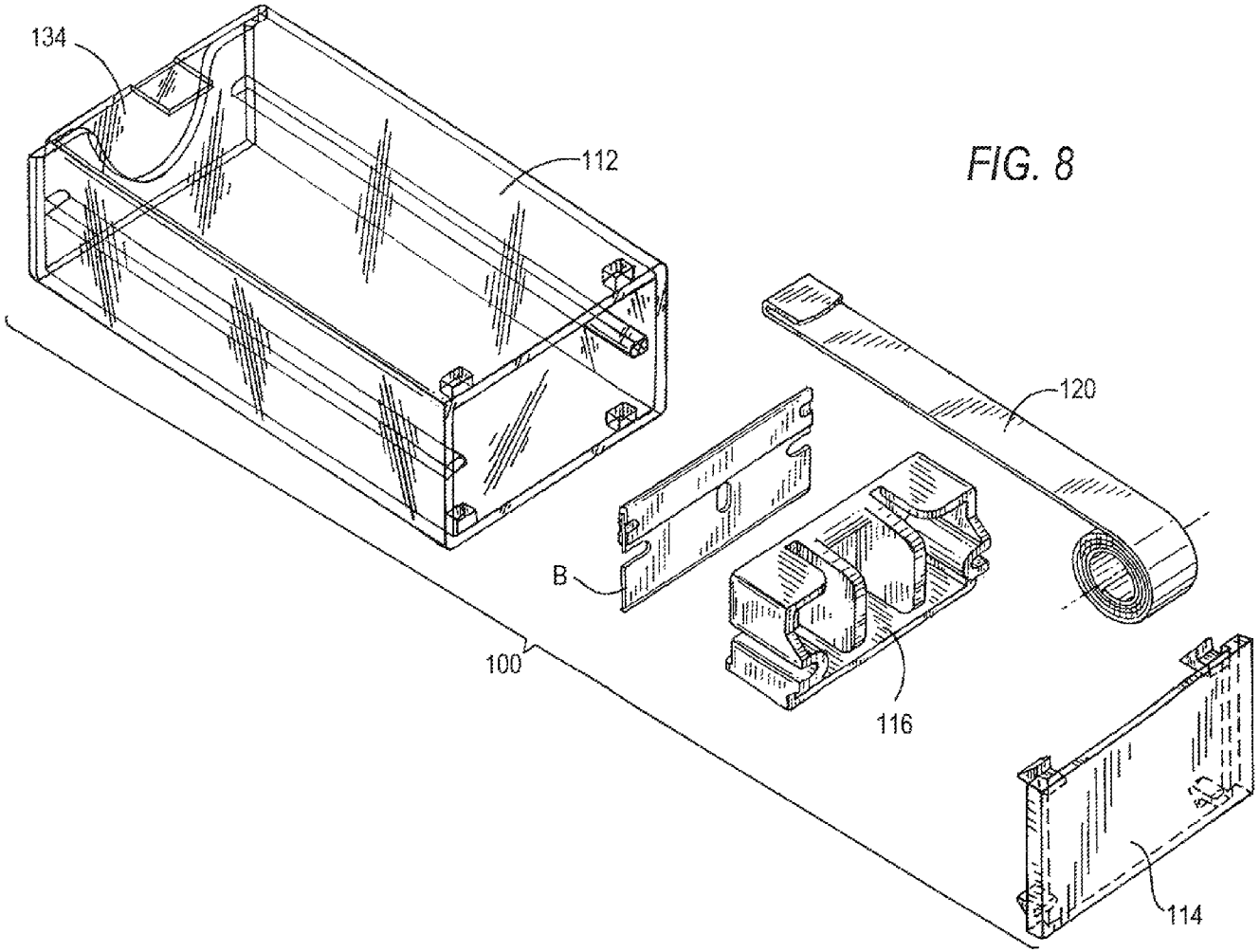
FIG. 8 is an exploded view of a second embodiment of a blade dispenser of the present invention.
Figure 9:
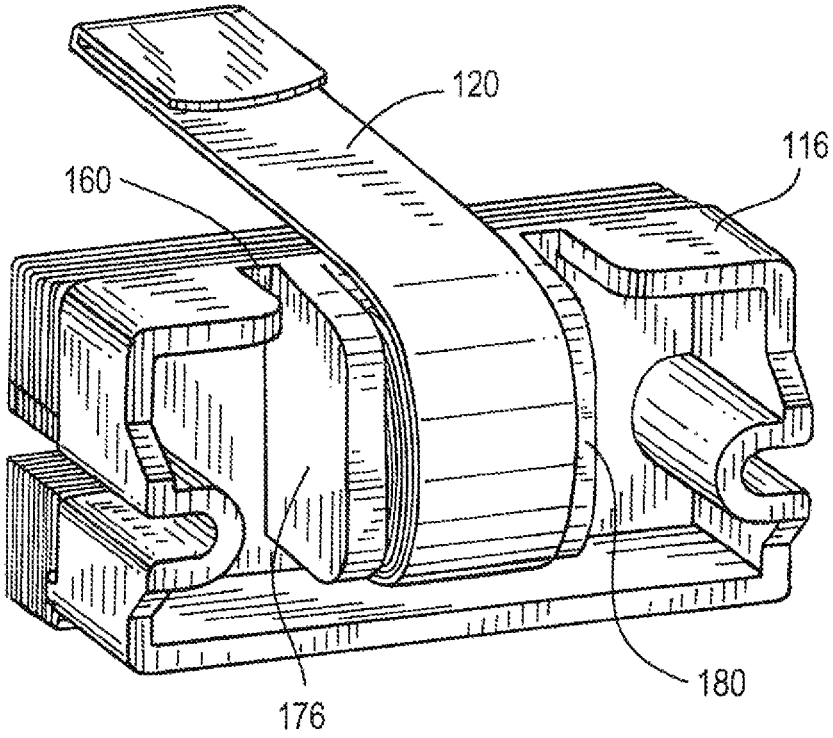
FIG. 9 is a perspective view of the pusher and spring of the blade assembly of FIG. 8 in an assembled state with a plurality of blades abutting the pusher.

FIG. 8 is an exploded view of a second embodiment of a blade dispenser assembly 100 of the present invention. The assembly includes a housing 112, a pusher 116, a spring 120 and a closure 114. As shown in FIG. 9, the spring 120 is directly contactable with the pusher 116 and arranged between a first flange 176 and a second flange 180 that extend outwardly from the front wall 160 of the pusher 116. A spool is not required to secure the spring 120 to the pusher 116. Through constant force, the spring 120 remains in contact with the pusher 116 and ensures the blades B easily removeable one at a time through the gap 134 formed in the housing 112.

Figure 10:
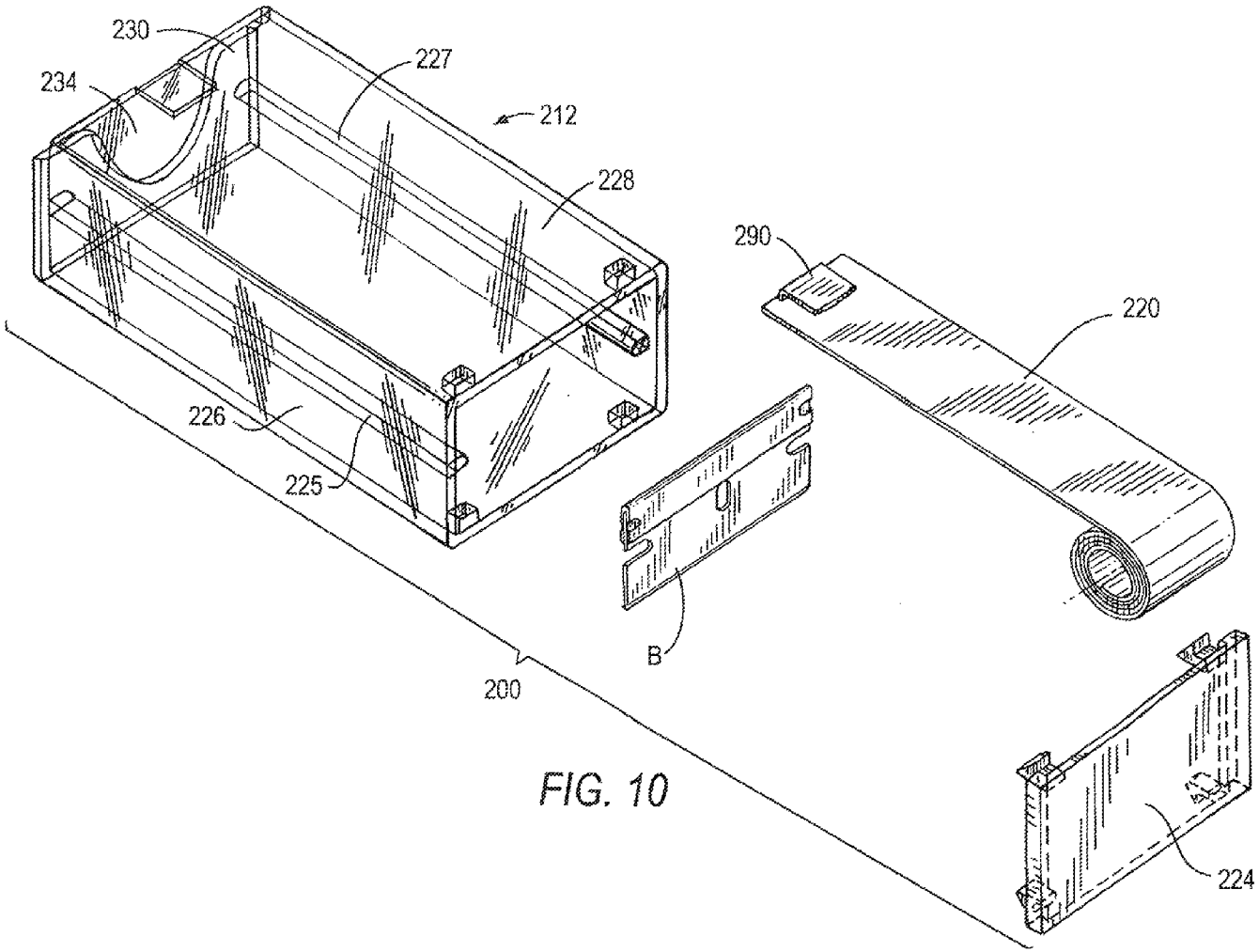
FIG. 10 is an exploded view of a third embodiment of a blade dispenser of the present invention.
Figure 11:
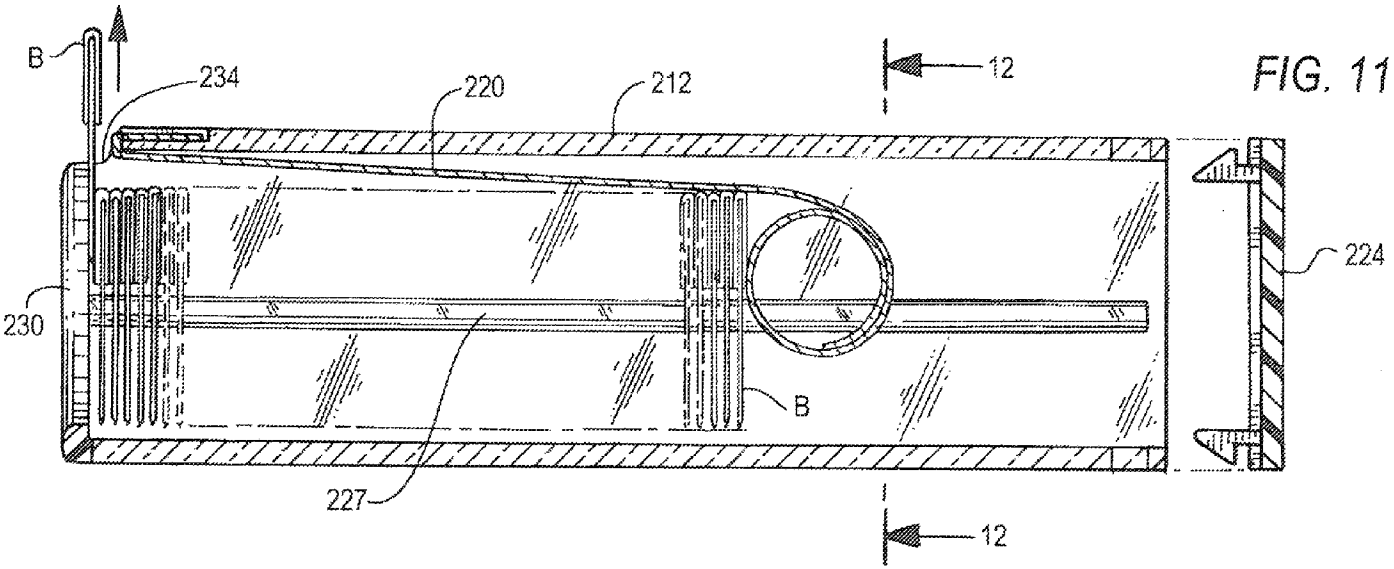
FIG. 11 is a side view of the blade dispenser assembly of FIG. 10.
Figure 12:
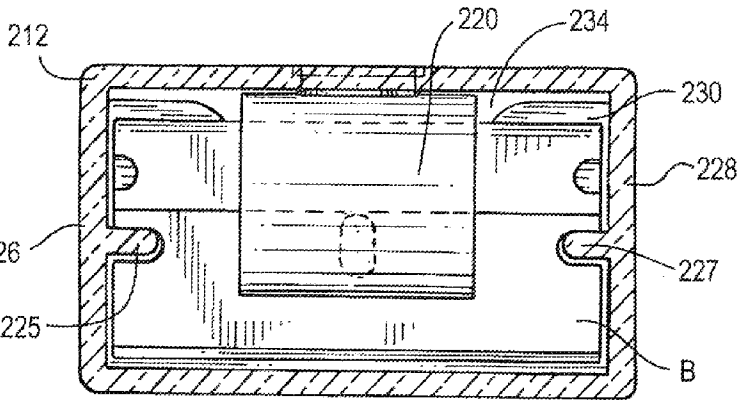
FIG. 12 is a cross-sectional view of the blade dispenser assembly of FIG. 10 taken along line 12-12 of FIG. 11.

FIGS. 10-12 illustrate a third embodiment of a blade dispenser of the present invention designated hereafter as reference number 200. As shown in FIGS. 10-12, the constant force spring 220 directly contacts blades B arranged in a housing 212, applying constant pressure on the blades B and directing the blades B away from the closure 224 and toward a front wall 230 of the housing 212 to ensure that the blades B are easily removable through a gap 234 formed in the front wall 230.

The constant force spring 221 includes a curved front end 290 for attachment to a recess 223 formed in a top wall 225 of the housing 212 and the spring 220 has a width that is greater than the curved front end 290 and greater than the overall width of the constant force spring 20 that contacts the pusher 16 in FIG. 1. The spring 220 aids in moving the blades B forward for removal from the housing 212 utilizing tracks, including a first track 225 and a second track 227 that extend inwardly from a first sidewall 226 and a second sidewall 228, respectively, toward the interior of the housing 212 such that the tracks 225, 227 form a track on which the blades B are arranged and may slide as they are forced forward for removal from the housing 212.

The accompanying drawings illustrate an embodiment of a blade dispenser and its respective constituent parts, however, other types and styles are possible, and the drawings are not intended to be limiting in that regard. Thus, although the description above and accompanying drawings contains much specificity, the details provided should not be construed as limiting the scope of the embodiment, but merely as providing illustrations of some of the features of the embodiment. The drawings and the description are not to be taken as restrictive on the scope of the embodiment and are understood as broad and general teachings in accordance with the present invention. While the present embodiment has been described using specific terms, such description is for illustrative purposes only, and it is to be understood that modifications and variations to such embodiment, including, but not limited to, the substitutions of equivalent features, materials, or parts, and the reversal of various features thereof, may be practiced by those of ordinary skill in the art without departing from the spirit and scope of the invention.

What is claimed is:

1. A dispenser for dispensing a plurality of blades, manually, one at a time, the dispenser comprising:

a housing including a dispensing slot at one end thereof and an opening for filling the dispenser at the other end thereof;

a pusher located within the housing engaging the plurality of blades;

tracking means located within the housing, the pusher mounted on the tracking means for movement from the opening toward the dispensing slot; and a spring located within the housing engaging the pusher and the housing and biasing the pusher and the plurality of blades toward the dispensing slot, wherein only one of the blades that is adjacent to the dispensing slot is removeable at a time, wherein the housing includes a top wall, a bottom wall, a first sidewall extending between the top wall and the bottom wall and a second sidewall spaced from the first sidewall and extending between the top wall and the bottom wall and a front end wall, wherein the top wall includes a recess formed therein that is configured for engagement with the spring, and wherein the spring has a curved first end that is configured to extend through the recess formed in the top wall of the housing.

2. The dispenser as claimed in claim 1, wherein the dispensing slot is formed in the front end wall and extends transverse between the first sidewall and the second sidewall and a recess extends from the slot in the front end wall toward the bottom wall.

3. The dispenser as claimed in claim 2, wherein the recess is substantially U-shaped and configured for insertion of a finger to contact and dispense one of the blades from the housing.

4. The dispenser as claimed in claim 1, wherein the tracking means includes a first track protruding from the first sidewall toward the second sidewall and a second track protruding from the second sidewall toward the first sidewall with the first track and the second track being parallel to each other.

5. The dispenser as claimed in claim 4, wherein a gap extends between a first end of the first track and the front wall and a first end of the second track and the front wall to allow the blades to be disengaged from the tracks and removed from the dispenser through the slot.

6. The dispenser as claimed in claim 4, wherein the pusher includes a first sidewall with a first recess extending inwardly from the first sidewall and is adapted to be arranged on the first track and a second recess extending inwardly from the second sidewall and adapted to be arranged on the second track.

7. The dispenser as claimed in claim 1, further comprising a closure that is releasably connectable to the housing to seal the opening of the housing.

8. The dispenser as claimed in claim 7, further comprising a plurality of openings formed in the housing that are adapted to interact with and releasably fix the closure to the housing.

9. The dispenser as claimed in claim 8, wherein the closure includes a plurality of fasteners to releasably connect the closure to the housing.

10. The dispenser as claimed in claim 9, wherein the fasteners are latches that are configured to flexibly be arranged within the openings of the housing.

11. The dispenser as claimed in claim 1, wherein the spring is a constant force spring.

12. The dispenser as claimed in claim 1, further comprising a spool that is connectable with the pusher, has a cylindrical body and includes a first end and a second end that each has a diameter that is greater than the cylindrical body.

13. The dispenser as claimed in claim 12, wherein the spool is non-rotatably fixed to the pusher.

14. The dispenser as claimed in claim 12, wherein the spool is rotatably fixed to the pusher.

15. The dispenser as claimed in claim 1, wherein the pusher has a substantially linearly extending front face for abutting the blades.

16. The dispenser as claimed in claim 1, further comprising a spool that is connectable to the pusher, wherein the pusher includes a front wall and a first protrusion that extends from the front wall and has a first groove formed extending in a first direction and a second protrusion that extends from the front wall and has a second groove formed therein that is spaced from the first protrusion and that extends in the first direction from the first wall and the spool configured to be retained with the first groove and the second groove of the pusher.

17. The dispenser as claimed in claim 16, wherein the spring is arranged on the spool and the spring extends between the first protrusion and the second protrusion of the pusher and is pre-stressed to press against the pusher in an assembled state.

18. The dispenser as claimed in claim 1, wherein at least the housing is made of a transparent thermoplastic.

19. A dispenser for dispensing a plurality of blades, one at a time, the dispenser comprising:

a housing including a top wall, a bottom wall, a first sidewall extending between the top wall and the bottom wall and a second sidewall spaced from the first sidewall and extending between the top wall and the bottom wall and a front end wall and a slot at one end thereof;

a pusher located within the housing and engaging the plurality of blades;

tracks extending from the housing inwardly toward each other with the pusher mounted on the tracks for movement of the pusher toward the dispensing slot; and a constant force spring arranged within the housing and engaging the pusher and the housing, biasing the pusher and the plurality of blades toward the dispensing slot, wherein one of the blades that is adjacent to the dispensing slot is removeable through therethrough, wherein the top wall includes a recess formed therein that is configured for engagement with the spring, and wherein the spring has a curved first end that is configured to extend through the recess formed in the top wall of the housing.

20. A dispenser for dispensing a plurality of blades, one at a time, the dispenser comprising:

a housing including a top wall, a bottom wall, a first sidewall extending between the top wall and the bottom wall and a second sidewall spaced from the first sidewall and extending between the top wall and the bottom wall and a front end wall and a slot at one end thereof; and a constant force spring arranged within the housing and engaging the plurality of blades and the housing, biasing the plurality of blades toward the dispensing slot, wherein one of the blades that is adjacent to the dispensing slot is removeable through therethrough, wherein the top wall includes a recess formed therein that is configured for engagement with the spring, and wherein the spring has a curved first end that is configured to extend through the recess formed in the top wall of the housing.

21. The dispenser as claimed in claim 20, wherein the constant force spring is in direct contact with the plurality of blades.

* * * * *